United States Patent [19]

Murphy

[11] Patent Number: 4,628,557

[45] Date of Patent: Dec. 16, 1986

[54] ADJUSTABLE HOSPITAL MATTRESS WITH REMOVABLE INSERTS

[75] Inventor: Michael E. Murphy, LaCrescent, Minn.

[73] Assignee: Lutheran Hospital Foundation, Inc., LaCrosse, Wis.

[21] Appl. No.: 650,585

[22] Filed: Sep. 14, 1984

[51] Int. Cl.[4] ..... A47C 20/02; A47C 27/00

[52] U.S. Cl. ..... 5/446; 5/465; 5/468; 5/464

[58] Field of Search ..... 5/446, 462, 464, 465, 5/468, 481, 493; 297/DIG. 6; 24/306

[56] References Cited

U.S. PATENT DOCUMENTS

| | | | |
|---|---|---|---|
| 389,420 | 9/1888 | Sutton | 5/468 |
| 934,465 | 9/1909 | Rust | 5/468 |
| 1,040,795 | 10/1912 | Skeffington . | |
| 1,276,361 | 8/1918 | Hobert . | |
| 1,548,728 | 8/1925 | Milam | 5/462 |
| 3,058,124 | 10/1962 | Sturtevant | 5/468 |
| 3,146,469 | 9/1964 | Slade | 5/462 |
| 3,419,920 | 1/1969 | Maddux | 5/465 |
| 3,451,071 | 6/1969 | Whiteley . | |
| 3,639,927 | 2/1972 | Munch . | |
| 3,742,528 | 7/1973 | Münch | 5/462 |
| 3,828,377 | 8/1974 | Eary | 5/465 |
| 4,292,703 | 10/1981 | Goguen | 5/468 |
| 4,327,714 | 5/1982 | Spann | 128/80 A |

*Primary Examiner*—Gary L. Smith
*Assistant Examiner*—Michael F. Trettel
*Attorney, Agent, or Firm*—Foley & Lardner

[57] ABSTRACT

A hospital mattress which is flexible and permits head elevation and knee flexion has removably securable inserts which can be repeatedly removed or replaced and secured without requiring substantial displacement of the patient. A body of resilient material, preferably closed-cell polymer foam, is utilized to form the mattress. The portion of the foam body disposed to underlie a predetermined portion of the patient's body, typically the patient's trunk, is removed. A flexible, generally impervious material, such as vinyl, is utilized to cover all exterior surfaces of the foam body and inserts, and to form a floor in the cut-out section of the foam body. The inserts are cushions adapted to be received in the recess defined by the cut-out portion. Each insert cushion is made of a block of resilient material and is covered with an impervious material. Elements of respective cooperating reusable fasteners, such as Velcro fasteners, are disposed on the recess floor and on the bottom of the inserts to releasably secure each insert within the recess at a desired position.

22 Claims, 5 Drawing Figures

ADJUSTABLE HOSPITAL MATTRESS WITH REMOVABLE INSERTS

The present invention relates to mattresses, and in particular to mattresses for use in hospitals including removable inserts to alleviate pressure on parts of a patient's body.

It is well known that bedridden patients are often subject to skin breakdown due to the patient's weight causing the skin to be pressed between the patient's bone and the bed, and heat and moisture build up between the skin and the bed. Skin breakdown is particularly prevalent in the vicinity of bony protrusions, and can occur in as short a time as 2–4 hours. Accordingly, to avoid skin breakdown a patient recumbent on a conventional mattress must be manually repositioned on a regular basis. Such a repositioning, however, can be extremely painful for many patients. It is therefore desirable to be able to vary the contour of the mattress to selectively remove pressure from localized areas without disturbing or moving the patient.

In general, mattresses having separable portions that can be removed from the area underlying a particular portion of the patient's body, and thus remove localized pressure and heat and moisture build up between the skin and the bed, are known. Examples of mattresses including separable portions are described in U.S. Pat. No. 1,004,795 issued to Skeffington on Oct. 8, 1912; U.S. Pat. No. 1,276,361 issued to C. Hobert on Aug. 20, 1918; U.S. Pat. No. 3,146,469 issued to C. C. Slade on Sept. 1, 1964; U.S. Pat. No. 3,451,071 issued to J. G. Whiteley on June 24, 1969; and U.S. Pat. Nos. 3,639,927 and 3,742,528 issued to J. Munch on Feb. 8, 1972 and July 3, 1973, respectively.

Such prior art mattresses, however, are disadvantageous in a number of respects. For example, if a patient is maintained in a horizontal position for an extended period, fluid tends to accumulate in the patient's lungs, causing respiratory complications. In addition, a patient tends to suffer fatigue from remaining in a horizontal position and often experiences dizziness when finally able to rise. Likewise, it is often necessary to provide for elevation of the feet of a recumbent patient to prevent swelling of the lower extremities. For this reason, conventional hospital beds provide for selective head elevation and knee flexion.

The prior art mattresses with separable portions, however, are typically not compatible with standard hospital beds adapted to provide for head elevation and knee flexion. Rather, the prior art mattresses require a rigid baseplate in order to accommodate use of a pressure activated adhesive film or "peg and hole" mechanisms to secure component inserts in position, or provided no mechanism for securing the components in position (so that the components tended to be displaced when the contour of the bed frame was changed).

It has also been known to utilize a sheet of resilient polymer foam, to overlie or replace a conventional mattress, to cut out portions of the foam underlying various body portions of the patient as necessary. However, such "cut away" foam sheets are particularly susceptible to soiling, and are not amenable to reuse with successive patients. Further, in many instances it is necessary to remove pressure from different portions of the patient's body over the course of several days, and to restore support under previously affected portions of the body. A "cut away" foam sheet typically does not permit replacement of "cut away" portions once such portions are removed. Likewise, prior art mattresses utilizing precut sections secured with a pressure activated adhesive film, adhesive pastes or the like, typically do not permit resecuring of an insert once it is removed. Other of the prior art requires removal or major displacement of the patient in order to vary the structure of the mattress.

Prior art pressure alleviation systems, which replace conventional hospital beds, are also known. Such systems typically include a special frame and a complex arrangement of pressurized air, sand, water or a combination thereof. Such systems, however, tend to be exceedingly expensive.

SUMMARY OF THE INVENTION

The present invention provides a hospital mattress which is flexible and permits head elevation and knee flexion, while also providing for removably securable inserts which can be repeatedly removed or replaced and secured without requiring substantial displacement of the patient. More specifically, a body of resilient material, preferably closed cell polymer foam, is utliized to form the mattress. The portion of the foam body disposed to underlie a predetermined portion of the patient's body, e.g., the patient's trunk, is removed. A flexible, generally impervious, e.g., waterproof material, such as, for example, vinyl, is utilized to cover all exterior surfaces of the foam body, and to form a floor in the cut out section of the foam body. A plurality of insert cushions adapted to be received in the recess formed by the cut out portion are provided. Each insert is formed of a block of resilient material, e.g., closed cell polymer foam, with the exterior surfaces thereof covered with a generally impervious, e.g., waterproof material. Respective cooperating reusable adhesion materials such as fibrous material and a material including a multiplicity of flexible barbs adapted to catch in the fibrous material (e.g., Velcro) are disposed on the recess floor and on the bottom of the inserts to releasably secure the insert within the recess.

BRIEF DESCRIPTION OF THE DRAWING

A preferred exemplary embodiment will hereinafter be described in conjunction with the appended drawing, wherein like designations denote like elements, and.

DETAILED DESCRIPTION OF A PREFERRED EXEMPLARY EMBODIMENT

Figure 1:
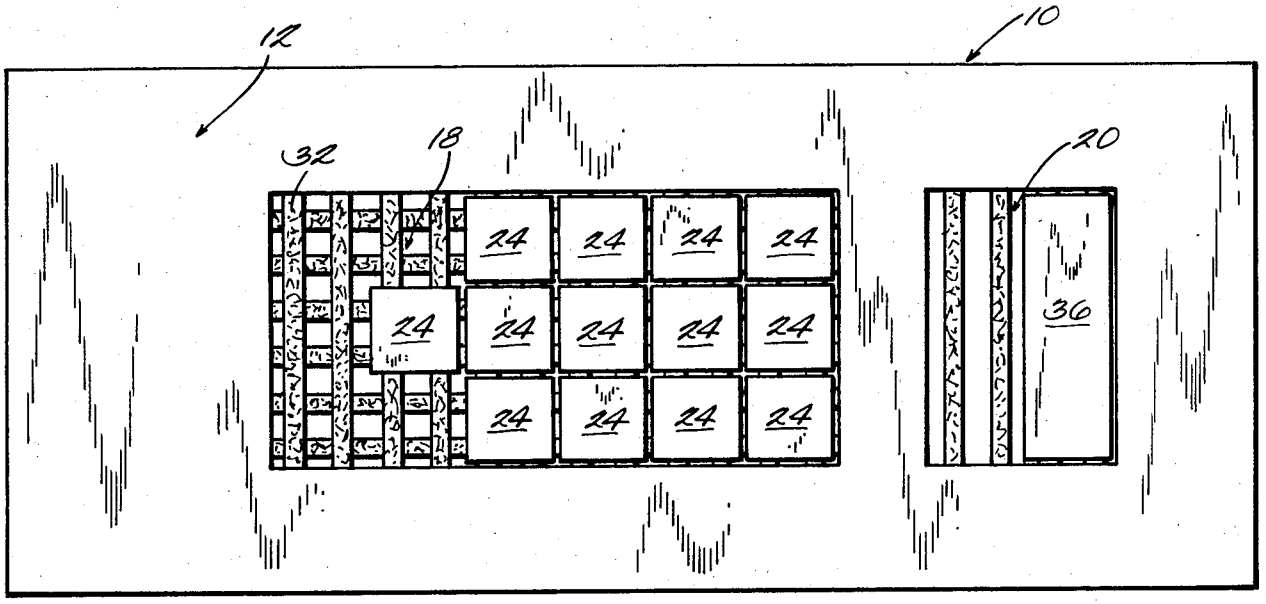
FIG. 1 is a top view of a mattress in accordance with the present invention, with all inserts removed.
Figure 2:
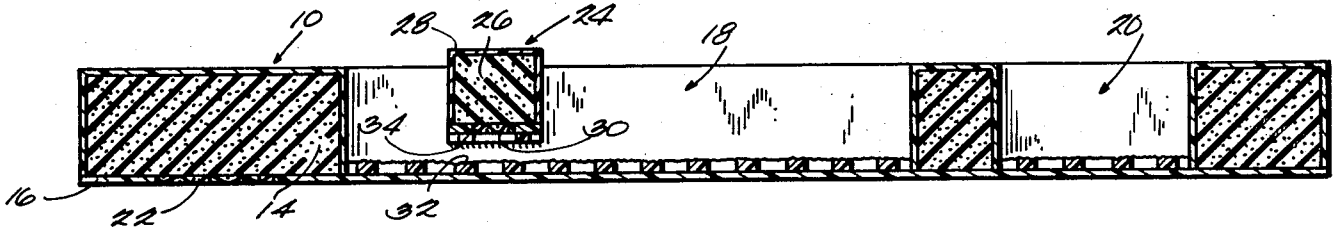
FIG. 2 is a sectional, side elevation view of a mattress in accordance with the present invention, and a single insert.

Referring now to FIGS. 1 and 2, there is shown a mattress 10 in accordance with the present invention.

A main body 12 (FIG. 2) is formed of a slab of a resilient material such as closed cell polymer foam. The exterior surfaces of the resilient material are covered by a sheet 16 of generally impervious (e.g., waterproof)

material such as vinyl. Main body 12 manifests the dimensions of a conventional mattress, e.g., 80 inches long and 36 inches wide. A section, corresponding to the portion of mattress 10 that would underlie a predetermined portion, e.g., the trunk, of a recumbent patient, is cut out and removed from the body of resilient material 14, to form a recess 18. Recess 18 is typically on the order of 18 inches wide and 36 inches long, disposed 12 to 18 inches from the head of mattress 10 and 9 inches from each side. A second portion of foam body 14 corresponding to the area underlying the feet of a recumbent patient is similarly cut out and removed. Vinyl sheet 16 covers all of the exterior surfaces of foam body 14. The respective seams are bonded with a permanent cement to form a waterproof seal. If desired, the seams may also be sewn to strengthen the bonding.

As shown in FIG. 2, vinyl sheet 16 stretches across the bottom of respective cut out portions 18 and 20, to form a flexible floor for the respective recesses. One or more air vents, such as screen 22 are suitably provided through vinyl sheet 16 on the bottom and/or sides of mattress 10, to facilitate compression of foam 14. The relative firmness of mattress 10 can be modified by varying the venting characteristics of the mattress.

Recess 18 is adapted to receive one or more insert cushions 24. Insert cushions 24 are suitably formed of a block 26 (FIG. 2) of resilient material, such as closed cell polymer foam, and are of a height commensurate with the depth of recess 18. For example, main foam body 14 is suitably approximately 6 inches thick. Accordingly, foam blocks 26 are suitably cubes, 6"×6"×6". Each insert 24 is covered with a generally impervious material 28, such as vinyl, in a manner similar to main body 12. Again, the respective seams are bonded to form an essentially waterproof seal, and may additionally be sewn to strengthen the bond. Essentially all exterior surfaces of the insert are covered by vinyl 28.

The respective inserts 24 each include a venting mechanism to facilitate compression of the insert. The particular venting mechanism is chosen in accordance with the desired firmness of the insert cushion and in accordance with the sanitation requirements for the particular usage of the cushion, i.e., the likelihood of contact with soiling substances, such as drainage from wounds and urine. For example, where the pooling of substances in recess 18 is unlikely, a screen 30 (FIG. 2, FIG. 3) is suitably disposed in the bottom surface of the cushion.

Figure 4:
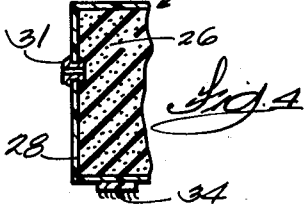
FIG. 4 is a partial sectional side elevation view of another embodiment of an insert cushion in accordance with the present invention.
Figure 5:
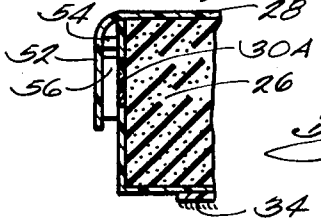
FIG. 5 is a partial sectional side elevation view of a further embodiment of an insert cushion in accordance with the present invention.

An embodiment of insert 24 suitable for situations where contact with soiling substances tends to occur, is shown in FIG. 4. One or more suitable vent plugs 31, formed of plastic or metal and including one or more air passages therethrough, can be disposed in the sidewalls of insert 24. Plugs 31 are disposed at levels above that which liquid is likely to pool in recess 18. Vents 31 also suitably include slightly protruding outer lips to divert any liquids which might run down the side of insert 24 away from the plug air passage orifices. Another alternative venting mechanism is shown in FIG. 5. A Screen 30A is disposed in the side wall of insert 24, at a level above that which liquid is likely to pool. A flap 52 of vinyl is disposed depending from the top surface of insert 24 and extending downwardly along the side of insert 24 to overlie screen 30A. Respective steps 54, 56 of vinyl, suitably of double thickness, are disposed above (54) and on either side (56, only one strip shown) of screen 30A. Strips 54 and 56 are secured to both flap 52 and the insert sidewall, to ensure that flap 52 does not totally obstruct air flow through screen 30A during a re-expansion of insert 24 after being compressed. Flap 52 prevents soiling liquids which run down the side of insert 24 and otherwise might be drawn into foam 26 during an expansion of the insert, from entering insert 24 through screen 24.

Another venting mechanism suitable in some circumstances, is to omit sealing a portion of the vertical seams along the sidewalls of insert 24. That is, rather than bonding the entirety of the vertical seams with a permanent cement, a portion of the seaming is effected solely by sewing, so that air can pass through that portion of the seam. Typically, the unsealed portion is disposed above liquid pooling levels in recess 18. If desired an overlying offset flap similar to flap 52 can be utilized.

Referring again to FIGS. 1, 2, and 3, inserts 24 are removably secured in a desired position within recess 18 through cooperation of respective reusably interactive materials, such as Velcro, disposed on the floor of recess 18 and on the bottom of each insert 24.

A pattern of a fibrous material, e.g., strips 32, is disposed on the floor of recess 18. More particularly, as shown in FIG. 1, strips 32 can be set in a mesh pattern so that a first set of strips 32 extend in the lengthwise direction of mattress 10 and a second set of strips 32 extend in the widthwise direction of mattress 10. In the embodiment shown, strips 32 of the first set span opposite sides of the floor of recess 18, and strips 32 of the second set span opposite ends of the floor of recess 18.

To facilitate sanitation, a removable mat of the fibrous material conforming to the floor of recess 18 can be utilized as desired, rather than a mesh of strips 32. Such a removable mat would be removably secured in recess 18 by snaps or other fastening mechanisms, not shown. A corresponding pattern, e.g., strips 34, of a material having a multiplicity of barbs or hooks adapted to releasably catch in the fibers of strips 32 is affixed to the bottom of each insert cushion 24. As is best seen from FIG. 3, strips 34 of barbed material are fixed, suitably permanently glued, to the underside of insert cushion 24. Where a screen 30 is utilized in the underside of insert 24, strips 34 can, if desired, be disposed to cover the peripheral edge of screen 30 and thus secure screen 30 to vinyl sheet 28.

Figure 3:
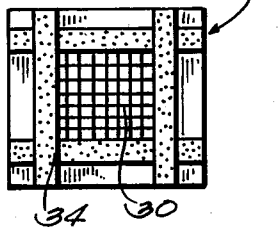
FIG. 3 is a bottom view of one embodiment of an insert cushion in accordance with the present invention.

As shown in FIG. 3, strips 34 can be disposed in a mesh pattern. More particularly, a first pair of parallel, spaced-apart strips 34 are disposed on the underside of insert 24 on opposite sides of screen 30, and a second pair of parallel, spaced-apart strips 34 are disposed on the underside of insert 24 perpendicular to the strips of the first set and on opposite sides of screen 30.

Recess 20 is similarly adapted to receive inserts 36. Each insert 36 is of a construction similar to inserts 24, but is of a width commensurate with the width of recess 20, e.g., 18 inches. As with recess 18 and inserts 24, respectively adherent strips are provided in a predetermined pattern on the floor of recess 20 to interact with corresponding adherent strips on insert cushion 36. Two relatively large inserts 36 are preferably utilized in recess 20 rather than a larger number of smaller inserts 24 to provide support for the patient.

In use, one or more of inserts 24 and 36 can be removed from recesses 18 or 20 to avoid contact between a particular area of the patient's skin and the bed, while the remaining portions of the mattress provide proper support for the surrounding body tissue. For example, an insert 24 can be removed so that a bony protrusion of the patient's body is suspended over the recess, while relatively localized support is provided to surrounding body portions.

It should be appreciated that the present invention provides a particularly advantageous mattress. Insert cushions 24 can readily be removed and/or reinserted in recess 18 without necessitating removal or major displacement of the patient. A nurse can depress the portion of main body 12 with one hand and reach into recess 18, under the patient, to access the particular insert cushion 24 to be removed. The insert cushion is then crushed (compressed) by hand, and withdrawn from under the patient. Likewise, an insert cushion can be secured in recess 18 by depressing the adjacent portion of main body 12, reaching under the patient with a compressed insert 24, disposing insert 24 in the desired position, pressing the bottom of the insert against the adherent mesh, then removing the hand and permitting insert 20 to expand beneath the patient.

Further, recess 30 and insert cushions 36 provide for suspending the point of the bone in the patient's heels, without requiring elevation of the legs, and thus tending to avoid nerve damage. More specifically, where a foot is elevated and dangles without support for lengthy periods, nerve damage can occur. Such nerve damage is often so severe that use of a brace or extensive therapy is necessitated. By removing only that section of the mattress underlying the heels, contact is removed from the point of the bone in the heel, without permitting foot drop to occur.

Moreover, the use of a fiber-multibarbed adherent mechanism and flexible sheeting permits elevation and flexion of various portions of the mattress while at the same time maintaining the individual inserts securely in desired positions and permitting reuse and rearrangement of the inserts. Further, vinyl coverings 16 and 28 are relatively impermeable to moisture, and are thus easily sanitized.

It will be understood that the above description is of preferred exemplary embodiments of the present invention, and that the invention is not limited to the specific forms shown. Modifications may be made in the design and arrangement of the elements without departing from the spirit of the invention as expressed in the appended claims.

What is claimed is:

1. In a mattress of the type comprising a main body including a cut out section disposed to underlie a patient recumbent thereon, and insert cushions adapted to be received in said cut out section, the improvement wherein said mattress further includes:

a first cover element, formed of flexible, generally impervious material, covering the exterior surfaces of said main body and forming a floor in respect of said cut out section;

second cover elements, associated with each said insert cushion, formed of flexible, generally impervious, material and covering the exterior surfaces of each of said associated insert cushions;

respective vent means, at least one associated with each of said insert cushions, for facilitating compression and re-expansion of said insert cushion;

repeatable adhesion means for releasably securing said insert cushions within said cut out section, said adhesion means comprising a first element disposed in a predetermined mesh pattern covering said floor of said cut out section and respective second elements disposed on said insert cushions, said first and second adhesion means elements being formed of respective materials which releasably interact to adhere when pressed together.

2. The mattress of claim 1 wherein one of said adhesion means elements is formed of a fibrous material, and the other formed of a synthetic material including a multiplicity of flexible barbs adapted to releasably catch in the fibrous material.

3. The mattress of claim 1 wherein said vent means comprises a screen covering with an orifice in said second cover element.

4. The mattress of claim 3 wherein said screen is disposed in the sidewall of said insert cushion and said vent means further comprises a flap of flexible, generally impervious material overlying said screen to divert soiling substances from said screen.

5. The mattress of claim 1 wherein said vent means comrpises a plug disposed in the sidewall of said insert cushion providing a passageway through said second covering, and including a projection lip to divert liquids from said passageway.

6. The mattress of claim 1 wherein said second cover element includes respective seams, and means for sealably bonding said seams, and said vent means comprise a non-sealed seam portion, said non-sealed seam portion not being sealably bonded, to thereby permit passage of air therethrough.

7. The mattress of claim 6 wherein said non-sealed seam portion is disposed at a level removed from a predetermined distance from the bottom of said insert cushion.

8. The mattress of claim 1 wherein said second adhesion element is formed of a material including a multiplicity of flexible barbs adapted to catch in fibers of said first material.

9. A mattress for receiving a recumbent patient comprising:

a main body of resilient material having a first principal surface for receiving said patient and an opposing surface, said main body including at least one cut out portion disposed to underlie a predetermined portion of said patient;

a flexible generally impervious main covering, surrounding said main body, generally conforming to the exterior shape of said main body, and extending across said cut out portion to define, in cooperation with said cut out portion, a recess of a predetermined depth with respect to said principal surface;

a first adhesion element, comprising a mesh formed of a first material of the type which releasably adheredly interacts with a second material when such first and second materials are pressed together; said first adhesion element covering said main covering in said recess substantially completely;

a plurality of inserts of predetermined shape of a height in accordance with said predetermined depth, adapted to be received in said recess each of said inserts comprising:

an insert body of resilient material;

a generally impervious insert covering, surrounding said insert body, generally conforming to the shape of the insert body;

vent means, for permitting air to communicate through said insert covering to said insert body; and a second adhesion element, formed of said second material, fixed to said insert covering, disposed to interact with said first adhesion element, to releasably fix said insert within said recess, the position of said insert being adjustable over a continuous range of positions over substantially the entirety of said main covering within said recess.

10. The mattress of claim 9 wherein at least one of said main covering and said insert covering is formed of vinyl.

11. The mattress of claim 10 wherein at least one of said main body and said insert body is formed of closed cell polymer foam.

12. The mattress of claim 9 wherein at least one of said main body and said insert body is formed of closed cell polymer foam.

13. The mattress of claim 9 including a recess disposed to underlie a major portion of the trunk of said patient.

14. The mattress of claim 13 wherein said recess has dimensions in the plane of said principal surface of on the order of 18 inches across and 36 inches in length, and is disposed to begin between approximately 12 to 18 inches from the head of said main body.

15. The mattress of claim 14 including a second recess disposed to underlie the feet of said patient.

16. The mattress of claim 15 wherein said second recess area has dimensions in the plane of said principal surface of on the order of 18 inches across and 12 inches in length.

17. The mattress of claim 13 including a second recess disposed to underlie the feet of said patient.

18. The mattress of claim 9 including a recess disposed to underlie the feet of said patient.

19. The mattress of claim 9, wherein said first adhesion element comprises a plurality of strips, including a first set of strips extending in the lengthwise direction of said mattress and a second set of strips extending in the widthwise direction of said mattress.

20. The mattress of claim 19, wherein said strips of said first set span opposite sides of said recess, and said strips of said second set span opposite ends of said recess.

21. In a mattress of the type comprising a body including a cut out section disposed to underlie a patient recumbent thereon, and insert cushions adapted to be received in said cut out section, the improvement wherein said mattress further includes:

a first cover element, formed of flexible, generally impervious, material, covering the exterior surfaces of said main body and forming a floor in respect of said cut out section;

second cover elements, associated with each said insert cushion, formed of flexible, generally impervious, material and covering the exterior surfaces of said associated insert cushion;

respective vent means, at least one associated with each of said insert cushions, for facilitating compression and re-expansion of said insert cushion, each of said vent means comprising a screen covering an orifice in each of said second cover elements and a flexible, generally impervious flap depending from each insert cushion and folded over said screen from above said screen to completely cover said screen, said flap being effective for preventing soiling liquids running down the side of said insert cushions from entering said insert cushion through said screen;

repeatable adhesion means for releasably securing said insert cushions within said cut out section, said adhesion means comprising a first element disposed on said floor of said cut out section and respective second elements disposed on said insert cushions, said first and second adhesion means elements being formed of respective materials which releasably interact to adhere when pressed together; and a step disposed on each of said second cover elements for preventing said flap from obstructing air flow through said screen.

22. A mattress for receiving a recumbent patient comprising:

a main body of resilient material having a first principal surface for receiving said patient and an opposing surface, said main body including at least one cut out portion disposed to underlie a predetermined portion of said patient;

a flexible generally impervious main covering, surrounding said main body, generally conforming to the exterior shape of said main body, and extending across said cut out portion to define, in cooperation with said cut out portion, a recess of a predetermined depth with respect to said principal surface;

a first adhesion element, comprising a mesh formed of a first material of the type which releasably adheredly interacts with a second material when such first and second materials are pressed together; said first adhesion element overlying said main covering in said recess;

a plurality of inserts of predetermined shape of a height in accordance with said predetermined depth, adapted to be received in said recess each of said inserts comprising:

an insert body of resilient material;

a generally impervious insert covering, surrounding said insert body, generally conforming to the shape of the insert body;

vent means, for permitting air to communicate through said insert covering to said insert body; and a second adhesion element, formed of said second material, fixed to said insert covering, disposed to interact with said first adhesion element, to releasably fix said insert within said recess;

wherein said second adhesion elements each comprise a plurality of strips, and said second adhesion elements each include a first pair of parallel, spaced apart strips disposed on undersides of each of said inserts, and a second pair of parallel, spaced apart strips disposed on undersides of each of said inserts, said second pair of strips being substantially perpendicular to said first pair of strips; and said vent means comprises a screen covering an orifice in said impervious insert covering, and said screen is centrally disposed on the underside of each of said insert cushions between the strips of said first pair and also between the strips of said second pair.

* * * * *